United States Patent [19]

Bailey

[11] 4,109,847

[45] Aug. 29, 1978

[54] METHOD FOR REPLACING DIFFERENT RAILROAD CAR DOOR ROLLER ASSEMBLIES

[75] Inventor: John D. Bailey, Orland Park, Ill.

[73] Assignee: Railway Engineering & Supply Company, Inc., Oak Lawn, Ill.

[21] Appl. No.: 682,462

[22] Filed: May 3, 1976

[51] Int. Cl.[2] ..... E05D 13/02; B61D 19/00

[52] U.S. Cl. ..... 228/119; 29/401 B; 49/426

[58] Field of Search ..... 16/91; 49/220, 426; 228/119; 29/401 R, 401 B, 401 D, 401 F

[56] References Cited

U.S. PATENT DOCUMENTS

| | | | |
|---|---|---|---|
| 2,193,592 | 3/1940 | Harbert | 228/119 |
| 3,059,289 | 10/1962 | Roland | 49/426 X |
| 3,106,000 | 10/1963 | Beauchamp | 49/426 X |
| 3,129,469 | 4/1964 | Uphues et al. | 49/220 |
| 3,348,295 | 10/1967 | Bass, Jr. | 228/119 |
| 3,369,322 | 2/1968 | Ceyer et al. | 49/426 X |
| 3,970,234 | 7/1976 | Litt et al. | 228/20 |

*Primary Examiner*—Al Lawrence Smith
*Assistant Examiner*—K. J. Ramsey
*Attorney, Agent, or Firm*—Allegretti, Newitt, Witcoff & McAndrews

[57] ABSTRACT

A method and apparatus for selectively replacing any of a plurality of different types of railroad car door roller assemblies conventionally used with different types of railroad car door tracks. The method includes supplying a roller assembly replacement kit which includes a housing having a pair of spaced end sections wherein each of the end sections is constructed and arranged to rotatably support a roller member for movement on a cooperating one of the tracks. Each of the end sections has a pair of opposed side walls having downwardly projecting feet thereon. An intermediate section rigidly interconnects the end sections and an upright aperture is provided in the intermediate section. The kit also includes separate rigid guide blocks or pads, at least one hook member, and at least one threaded member. In replacing one selected type of roller assembly, the aperture in the housing is threaded and a threaded member is threadably secured into the threaded aperture. The housing then may be used to replace one type of roller assembly used in connection with one type of cooperating track. Other types of roller assemblies may be replaced in various ways including by welding guide blocks to the feet, by severing two feet, then welding guide blocks to each of the remaining feet, and welding the hook member to the top of the end section of the housing, or by severing two feet and welding J-shaped hooks to the remaining feet.

5 Claims, 17 Drawing Figures

METHOD FOR REPLACING DIFFERENT RAILROAD CAR DOOR ROLLER ASSEMBLIES

BACKGROUND OF THE INVENTION- FIELD OF THE INVENTION AND DESCRIPTION OF THE PRIOR ART

This invention relates to a method and apparatus for replacing any of a plurality of different types of railroad car door roller assemblies which are conventionally operatively positioned so as to rotatably carry a railroad car door for movement on any of a variety of different types of cooperating tracks.

Railroad car door assemblies which are commonly used today, generally, are the "plug" type of car door assembly. In this type of car door assembly, the railroad car door, when moved into position adjacent the opening in the side of the railroad freight car, is moved transversely inwardly into the opening to "plug" the opening. When the door is to be opened, the car door is moved transversely outwardly so that the door may move laterally along the outer surface of the side of the box car. The bottom edges of the car door are operatively secured to a plurality of roller assemblies which roll along suitable tracks which are mounted by the floor adjacent the door opening and adjacent the exterior surface of the railroad freight car.

Generally speaking, there are at least four different types of railroad car door roller assemblies which are commonly used, although there are still other types. The reason for the use of different types of car door assemblies is that there are several different manufacturers for railroad freight cars and each manufacturer has its own type of car door roller assembly and cooperating track. A large number of railroad car door roller assemblies in use today are similarly constructed as the roller assembly generally includes a housing having a pair of end sections, each of which is adapted to rotatably carry a roller member which is rotatable and movable along a cooperating track. The end sections are conventionally rigidly interconnected by an intermediate section. An upright aperture is provided in the intermediate section. Various types of guides are provided on the housing so as to cooperate with the roller assembly and the track in order to guide the movement of the roller assembly along the track to thereby assure that the car door moves properly along the track.

The upright aperture generally provided in the intermediate connecting section is constructed and arranged to rotatably carry one downwardly projecting end of an arm having an opposite, upwardly projecting end which is also rotatably carried in the lower portion of the car door itself. The pivoting arms permit the plug type door to be moved slightly inwardly and outwardly of the opening in the freight car.

While the different types of car door assemblies being commercially used today are generally quite satisfactory for their given purpose, one disadvantage common to each of the known devices is their lack of versatility. In other words, one manufacturer's roller assembly cannot be used with another manufacturer's car door and/or track assembly. In other words, each manufacturer generally supplies a car door roller assembly which is designed to be used only with its own equipment and not with another manufacturer's equipment. As a result, a railroad yard must have its shop stock each of the different types of roller assemblies being used so as to be sure that there are sufficient car door roller assemblies available for replacement of various types of railroad freight cars which pass through a railroad yard. The track and the door are considered to be a permanent part of the railroad car. Thus, even if a railroad decided to standardize on one type of railroad box car, using a given type of car door, a given type of roller, and a given type of track, since it is well known that a freight train is normally made up of a great variety of freight cars from different railroads, as a practical matter, there is no advantage for one railroad to attempt to standardize on its freight cars, car doors, car door roller assemblies or car door tracks. Thus, a repair shop in a railroad yard of a given railroad is required to maintain an inventory of various railroad car door roller assemblies for replacement of damaged or broken car door roller assemblies.

Clearly, it would be highly advantageous to provide a method and/or an assembly by which at least about four different types of car door roller assemblies could be replaced by using a basic repair kit which is readily adapted to being used in a railroad yard for replacing broken or damaged car door roller assemblies.

SUMMARY OF THE INVENTION

It is therefore an important object of this invention to provide a method and assembly or kit for replacing railroad car door roller assemblies for use with railroad freight cars wherein a single roller assembly replacement kit may be used for replacing several different types of railroad car door roller assemblies.

It is a further object of this invention to provide a highly versatile method and replacement assembly for railroad car door roller assemblies wherein the method and assembly are characterized by their economy and simplicity of construction and use.

It is also an object of this invention to provide an improved method for replacing car door roller assemblies for railroad freight cars wherein a single supply kit containing different parts is supplied, including a housing which is readily adapted in the field, as in a railroad freight yard, for use with any of a variety of railroad car door roller assemblies.

It is still another object of this invention to provide a replacement kit for railroad car door assemblies wherein the kit includes a housing and separate guide members, the housing being readily adapted to replace any of a variety of commercially available car door roller assemblies wherein the housing may be adapted to various uses by removing portions thereof and/or by welding track guide members thereon.

Further purposes and objects of this invention will appear as the specification proceeds.

The foregoing objects are accomplished by providing a method for selectively replacing any of a plurality of different types of a railroad car door roller assemblies which are used in cooperation with different types of railroad car door tracks and wherein the method includes supplying a roller assembly replacement kit which includes a housing with a pair of spaced end sections, each of which are constructed and arranged to rotatably support a roller member for movement along a cooperating track, each of the end sections having a pair of opposed side walls with downwardly projecting opposed feet, an intermediate section for rigidly interconnecting the end sections and an upright aperture in the intermediate section, the kit also including a separate rigid guide member and at least one separate hook member and preferably, separate threaded members; the upright aperture, in one embodiment, is threaded and receives one of the threaded members therein so as to act as a replacement for one existing roller assembly; in another embodiment, a pair of block guide members are welded to the inner surfaces of each of the feet and are positioned to face each other and to act as guides in cooperation with the track for guiding the movement of the roller assembly therealong; in still another embodiment, two aligned feet are severed while the two remaining, aligned feet have guide members secured thereon; the guide members in the kit may be of two different types, one type being a block guide pad while another type being a hook type which cooperates with the underside of a cooperating track; in all embodiments, the pads or hook members are preferably welded to the housing.

DETAILED DESCRIPTION OF THE PREFERRED EMBODIMENTS

Figure 1:
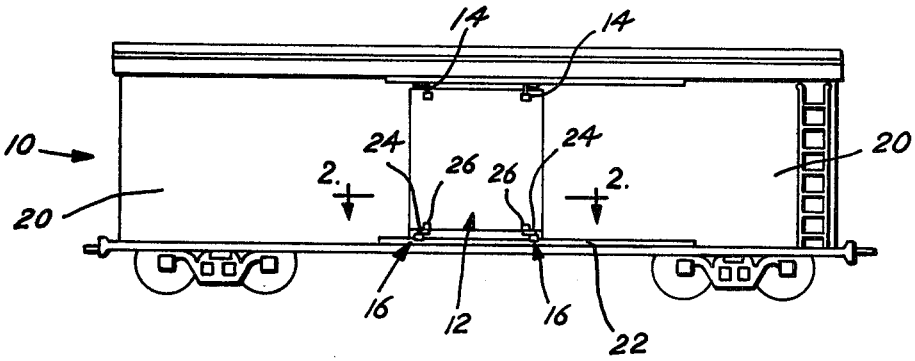
FIG. 1 is a side elevational view of a railroad freight car using a plug type of door, the plug type door utilizing roller assemblies at the lower portion thereof which are movable along a track positioned adjacent the door opening.
Figure 2:
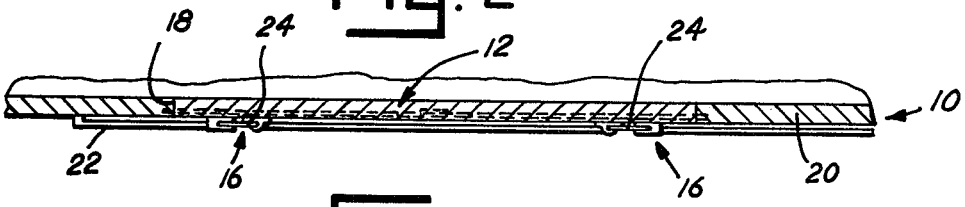
FIG. 2 is an enlarged sectional view taken along the line 2—2 of FIG. 1 illustrating the plug door when in the closed position.
Figure 3:
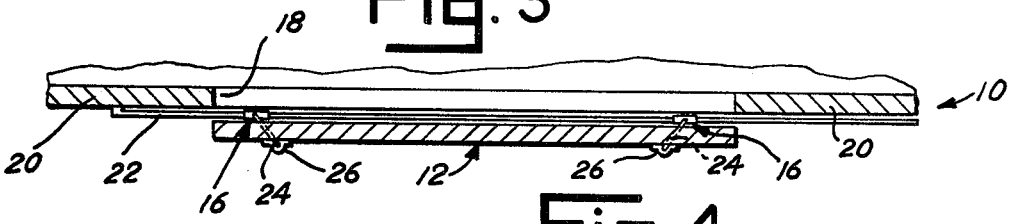
FIG. 3 is a view similar to FIG. 2, except the door is shown moved to the open position so that the door may be moved laterally along the opening.

Referring to FIGS. 1–3, there is shown a railroad freight car, generally 10, of generally conventional construction. A plug type freight car door, generally 12, is movably mounted on the car 10 for movement between open and closed positions. As seen in FIG. 1, the car door 12 is supported for movement between the open and closed position by a pair of upper guides 14 and by a pair of car door roller assemblies 16. The applicant's invention is directed to a method and apparatus for replacing at least four different types of railroad car door roller assemblies.

Referring to FIGS. 2 and 3, the car door 12 is constructed and arranged to move transversely of the longitudinal axis of the car 10, in and out of a door opening 18. With the plug type door 12, the outer surface of the door 12 is generally flush with the outer surface of a side wall 20 of the railroad freight car 10. Each of the roller assemblies 16 is rollably mounted on a fixed track 22 mounted along the outer surface of the car side 20 and adjacent the car floor or bottom of the door opening 18. Each roller assembly 16 rotatably carries a downwardly projecting portion (not shown in FIGS. 1–3) of a pivot arm 24 while the opposite end of the pivot arm 24 includes an upwardly projecting portion (not shown) which is pivotally or rotatably carried by a fixed support member 26. Each support member 26 is fixedly mounted on the lower exterior corner portions of the car door 12. Generally, two such roller assemblies 16 are used for movably suppporting the lower portions of each car door 12. As seen best in FIGS. 2 and 3, each pivot arm 24 permits the car door to be moved transversely outwardly from the opening 18, that is, from the position of FIG. 2 to that of FIG. 3. When the car door 12 is manually pushed or pulled outwardly, the arm 24 pivots, at its opposite ends, within the bearing members 26 and also within the roller assemblies 16. Each roller assembly 16 is rotatably moved along the track 22 slightly inwardly towards the other in the opening movement. At this time, the car door 12 may be moved along the outer surface of the car side 20 as the roller assemblies 16 roll along the track 22.

Figure 4:
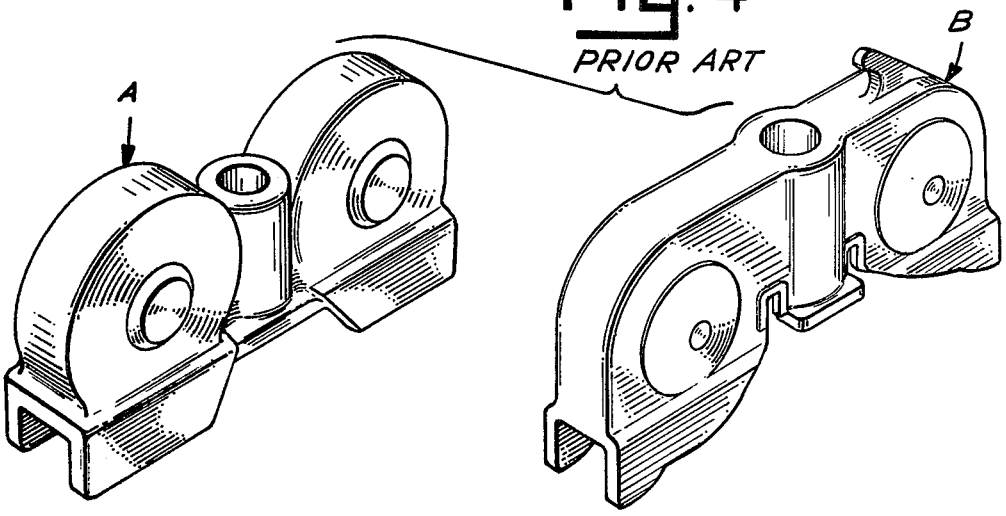
Fig. 4 PRIOR ART
FIG. 4 is a pictorial illustration of two known prior art car door roller assemblies.

It is to be understood that the general construction shown in FIGS. 1–3 is, generally speaking, conventional in the railroad industry in the construction of car doors and car door roller assemblies. Different track constructions 22 are used as are different roller assemblies 16 used. In FIG. 4 there are shown two different types of prior art roller assemblies A and B. Each prior roller assembly A and/or B, generally includes a housing carrying two roller members (not shown), and an upright opening between the two roller members. The opening rotatably receives the downwardly projecting portion (not shown) of the pivot arm 24. While only two prior art roller assemblies are shown, it is to be understood that there are several different types of car door roller assemblies being used in the industry today. The applicant's invention involves the replacement of at least four different types of roller assemblies 16 while using the same basic method and roller replacement kit.

In FIGS. 14–17, four different tracks being used on railroad cars 10 are shown. Each of the various tracks shown, which will be hereinafter described in greater detail, is normally constructed and arranged to operate with only one type of roller assembly. Various railroad car doors, car door roller assemblies and tracks known in the prior art and such doors, roller assemblies and/or tracks are shown in many U.S. patents, including the following:

| U.S. PAT. NO. | INVENTOR |
|---|---|
| 1,784,029 | Sisson |
| 1,826,049 | Campbell |
| 1,915,155 | Ekline et al |
| 2,658,243 | Beauchamp |
| 2,658,244 | Madland |
| 3,020,603 | Soddy |
| 3,059,289 | Roland |
| 3,106,000 | Beauchamp |
| 3,129,469 | Uphues et al |
| 3,169,574 | Behlen et al |
| 3,179,984 | Bailey |
| 3,190,239 | Davis et al |
| 3,216,067 | Bailey |
| 3,245,125 | Madland |
| 3,242,536 | Soddy |
| 3,334,441 | Landis et al |
| 3,369,322 | Ceyer et al |
| 3,386,205 | Herr |
| 3,488,074 | Herr |
| 3,492,687 | Herr |
| 3,555,731 | Ross, Jr. |
| 3,512,484 | Madland et al |
| 3,660,938 | Ross, Jr. et al |
| 3,760,536 | Wolak |
| 3,786,599 | Galbarzyk et al |
| 3,800,472 | Nagy |

Figure 5:
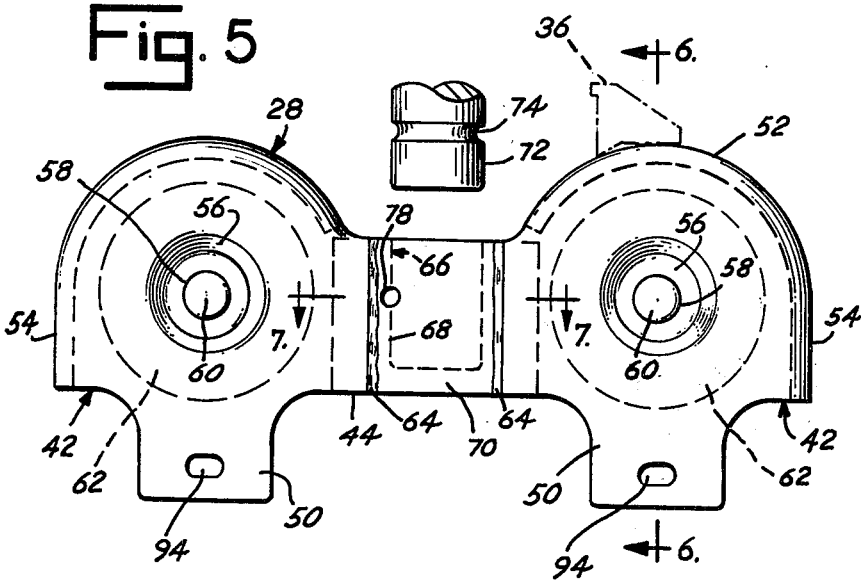
FIG. 5 is a side elevational view of one embodiment of housing assembly which may be supplied with my car door roller replacement kit.
Figure 6:
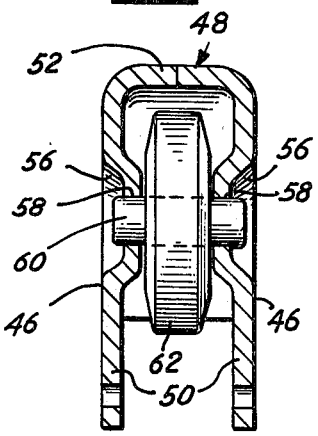
FIG. 6 is a transverse sectional view of the housing taken along the line 6—6 of FIG. 5.
Figure 7:
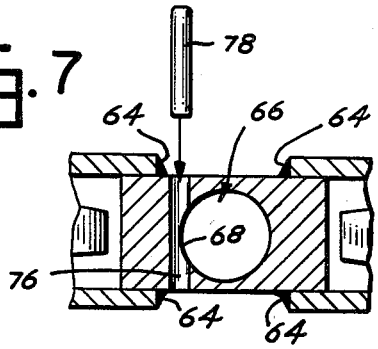
FIG. 7 is a fragmentary sectional view taken along the line 7—7 of FIG. 5 showing the intermediate portion of the housing embodied in FIG. 5.
Figure 8:
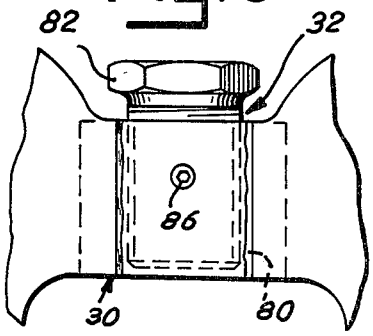
FIG. 8 is a fragmentary view of an alternate intermediate section for the housing of FIG. 5.
Figure 9:
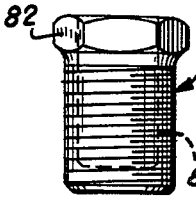
FIG. 9 is a side elevational view of one type of plug which is threadably received in a threaded aperture of the intermediate section as shown in FIG. 8, the plug being supplied with the replacement kit.
Figure 10:
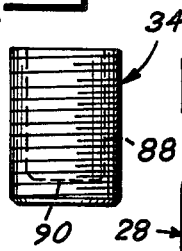
FIG. 10 is another type of plug used with the threaded intermediate section of the type shown in FIG. 8, the plug also being supplied with a replacement kit.
Figure 11:
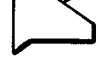
FIG. 11 is a side elevational view of a hook which is supplied in the kit and which may be secured to a portion of the housing.
Figure 12:
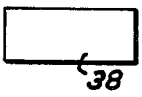
FIG. 12 is a side elevational view of one type of guide member, which is supplied with the replacement kit.
Figure 13:
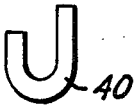
FIG. 13 is another type of guide member which is supplied with the car door roller replacement kit.

Referring to FIGS. 5–13, there are shown various parts of a roller assembly replacement kit which may be utilized in the field, as in a railroad yard in order to replace any of a variety of railroad car door roller assemblies. Referring to FIG. 5, there is shown one embodiment of a roller housing, generally 28, which is supplied with my replacement kit. Referring to FIG. 8, there is shown a fragmentary view of an intermediate section, generally 30, which may be used instead of the intermediate housing 28, as shown in FIG. 5. FIG. 9 shows one type of a threaded plug member, generally 32, which is supplied with the replacement kit. FIG. 10 shows another plug 34, which is also supplied with one replacement kit. Both the plugs 32 and 34 are used with the alternate embodiment of FIG. 8. FIG. 11 illustrates a hook member 36 used in type B of the prior art roller assemblies, one such hook 36 being supplied with the replacement kit. FIG. 12 illustrates a guide member comprising a pad or block 38, four of which are supplied with the kit. FIG. 13 shows a J-hook guide, generally 40, two of which are supplied with the replacement kit. All of the parts including both embodiments of the housing 28 (FIGS. 5 and 8), the plug 32, the plug 34, the hook member 36, the guide blocks 38 and the hook guide 40 are constructed of steel which is readily adapted to be welded. Because the parts are made of steel, fabrication is accomplished in the field, as in a railroad yard, simply by welding the selected part to the housing.

Referring to FIG. 5, the first embodiment of the housing 28 includes a pair of end sections generally 42, and an intermediate section 44, preferably welded to the end sections 42, so as to rigidly interconnect the two end sections 42. Referring to FIG. 5, each end section 42 includes a pair of upright side walls 46 which are rigidly interconnected by an intermediate peripheral wall 48. Each side wall 46 includes a downwardly projecting foot portion 50. Each peripheral wall 48 also includes a top wall portion 52 and an end wall portion 54. Each of the side walls 46 includes a central depressed section 56 having a central opening 58 which receives a pin 60. Each pin rotatably carries a roller member 62. Both roller members 62 are considered as part of the housing assembly, whether the embodiment of FIG. 5 or the embodiment of FIG. 8.

The intermediate interconnecting section 44 is rigidly secured to each of the end sections as by welds 64. The intermediate section of the embodiment of FIG. 5 includes a central upright aperture or well 66. In the embodiment of FIGS. 5 and 7, the aperture 66 includes an unthreaded cylindrical side wall 68 and a bottom wall 70. In the embodiment of FIG. 5, the aperture or well 66 is constructed and arranged to rotatably receive the downwardly projecting section 72 of a pivot arm 24. In order to assure that the downwardly projecting section 72 remains rotatably received within the well or aperture 66, the section 72 preferably includes a peripheral groove 74. As seen best in FIG. 7, a transverse opening 76 passes through the intermediate section 44 and partially intersects the cylindrical side wall 68 of the aperture 76. A pin, as seen in FIG. 7, is passed through the aperture 76 after the downwardly projecting section 72 has been placed therein. The aperture 76 in the intermediate section 72 and the groove 74 of the downwardly projecting section 72 are aligned so that the pin 78 rotatably secures the downwardly projecting section 72 of the arm 24 within the aperture 76. By using this arrangement, when a railroad freight car is moving over relatively rough road beds, there is substantial assurance that the pivot arm 24 will remain interconnected to the housing 28.

In the alternate embodiment for the housing 28, as seen in FIG. 8, the intermediate section 32 is constructed differently than the intermediate section 44 of FIG. 5. The intermediate section 30, as seen in FIG. 8, like the section 44, rigidly interconnects the two end sections 42, by welding. In the intermediate section 30, however, the upright aperture 80 extends completely through the intermediate section 30 and, as will be described hereinafter, selectively receives either the plug 32 or the pin plug 34 of FIGS. 9 and 10 respectively.

Referring to FIG. 9, the threaded plug 32 includes a threaded cylindrical outer wall which is constructed to be threadably received by the threaded opening 80 of the intermediate section 30 of the housing embodiment of FIG. 8. The screw plug 32 also includes an upper unitary hex portion 82 defining a unitary nut for enabling the mechanic to adjust the height of the plug 32 within the threaded opening 80, as will be described hereinafter. The plug 32 includes a central upright well 84 which is constructed and arranged to rotatably receive the lower end of the downwardly projecting section 72 of the pivot arm 24. As seen in FIG. 8, after the adjustable plug 32 has been moved to the desired height so that the car door 12 is set to its desired level, a set screw 86 is desirably passed through the side of the intermediate section 30 and securly engages the outer periphery of the adjustable screw 32 so as to secure the plug 32 in a rotationally locked position. The wall portion 84 is constructed to have a bottom wall and cylindrical sides.

Referring to FIG. 10, the pin plug 34 is constructed similarly to the adjustable plug 32 except that there is no hex portion provided thereon. The pin plug 34 includes an upright well portion 88 having a closed bottom wall 90. Again, like the adjustable plug 32, a set screw 86 is provided for securing the plug 34 within the threaded opening 80 of the intermediate section 30. The well 88 of the plug 34 has substantially the same dimensions as the well 66 of the intermediate section 44.

Referring to FIG. 11, there is shown a hook element 36 which is made of steel and is used in replacing one of the prior art embodiment B, such as shown in FIG. 4. The hook 36, illustrated in dotted line view in FIG. 5, is securely welded to the top 52 of the peripheral wall 48. The hook is used in cooperation with another element (not shown) in the prior art embodiment B, as shown in FIG. 4, to hold the door 12 in the open position.

FIG. 12 shows a side elevational view of the guide block 38 which, as will be described hereinafter, is welded to the inner face of one or more of the downwardly projecting feet 50 extending from the side walls 46 of the end sections 42 of either embodiment of the housing 28. The guide blocks 38, as will be described, cooperate with a roller track to substantially assure that the housing 28 stays in rolling relationship on the cooperating track.

FIG. 13 shows a guide J-hook having approximately the same width as the guide block 38 of FIG. 12. The guide 40 is adapted to be readily welded to the inner face of the feet 50 of the housing 28, as will be described hereinafter in greater detail.

In our method of replacing any of a variety of different types of railroad car door roller assemblies, as discussed above, a kit is supplied. Although not shown, the kit may be supplied in a variety of ways, as in a sack, a box or other containers which stores at least one set of components useful in replacing any of at least four different types of roller assemblies. Two basic kits are provided. In one kit, the housing embodiment 28 of FIG. 5 is provided. The first kit includes the housing 28, four guide pads 38, as shown in FIG. 12, and two of the hook guides 40 as shown in FIG. 13.

Figure 16:
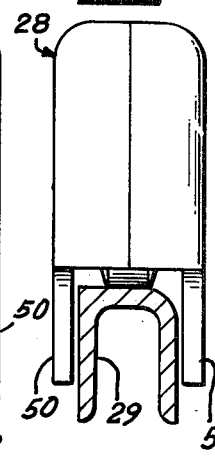
FIG. 16 is a view similar to FIGS. 14 and 15, showing the door housing used as a replacement for a third type of car door roller assembly.

Referring to the housing embodiment 28 of FIG. 5, the structure, as shown may be used, without change, as a replacement for one type of known railroad car door roller assembly. This replacement is shown in FIG. 16 wherein the feet 50 move along opposite sides of the track 24.

Figure 15:
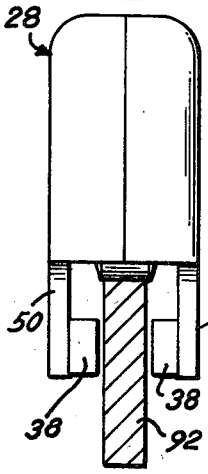
FIG. 15 is a view similar to FIG. 14, except the housing is shown in replacing a second type of car door roller assembly.

With respect to the embodiment of FIG. 5, in order to replace a second type of car door roller assembly, all four guide blocks 38 are welded to the inner faces of each of the four downwardly projecting feet 50 of the side walls 46. With this embodiment, the guide pads 38 are guidably positioned on opposite sides of a track 92, as seen in FIG. 15. The roller member 62 rides along the top of the track 92 while the four guide pads 38 move in close proximity to the opposite sides of the track 92. In welding the guide blocks 38 to the four feet 50 of the housing 28, openings 94 are provided in the sides of the feet 50 for enabling a weld to be provided at the central portion of each guide block 38, as well as along the periphery thereof to better assure secure joining of the guide pads 38 to the feet 50.

Figure 17:
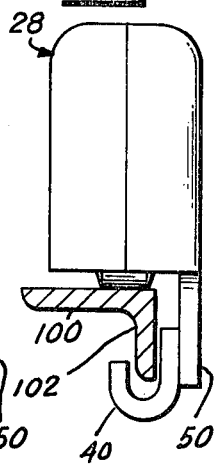
FIG. 17 is a view similar to FIGS. 14–16, illustrating the housing being used as a replacement for a fourth type of car door roller assembly.

To replace a third type of roller assembly, two inner or rear feet 50, aligned on one side of the housing 28 are completely severed so that the feet 50 are flush with the base of the side wall 46, as seen in the embodiment of FIG. 17. The remaining two feet each have a safety J-guide hook rigidly welded to the inner face thereof, as seen in FIG. 17. In the embodiment of FIG. 17, the track 100 cooperates with the J-shaped guide 40 which extends around the lower edge of the upright wall 102 of the track 100. The roller members 62 move along the upper portion or flange of the track 100.

The embodiment of FIG. 5 is thereby useful for replacing three existing types of car door roller assemblies. In using the kit, it is apparent that each kit includes one housing, and several other components, including the guide members 38 and 40, but not all components are used. In the embodiment of FIG. 5, in one use, only the housing is used; in the second use, the housing and four guide blocks 38 are used; and in the third use, the housing and two guide J-hooks 40 are used.

Figure 14:
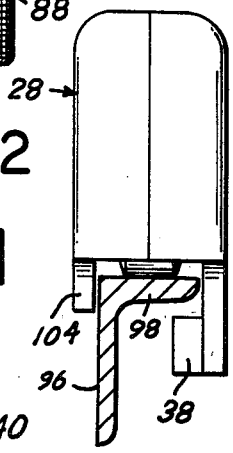
FIG. 14 is a partially sectioned, end elevational view of one roller assembly which has been adapted to replace one type of car door roller assembly.

The alternate housing embodiment of FIG. 8, in contrast to that of FIG. 5, is useful for replacing four different car door roller assemblies. The housing embodiment of FIG. 8 is used in a replacement kit which includes in addition to the hook 36 and guides 38 and 40, one plug 32 and one plug 34. The embodiment of FIG. 8, with the threaded housing aperture 80 therein, is used to replace a fourth type of roller assembly, in addition to the above described three types. In the fourth type of roller assembly, the adjustable plug 32 is threaded into the threaded aperture 80 and with the downwardly projecting section 72 of the pivot arm 24 therein, the adjustment screw is threadably adjusted to the desired height so that the door 12 is adjusted to roll properly. Because of the need for adjustment, the adjustment plug 32 is used for this embodiment; since the embodiment of FIG. 5 does not have the adjustability feature, it cannot be used in the fourth embodiment. In this embodiment, after the proper adjusted height of the plug 32 has been determined, the adjustment plug 32 is locked into place by the set screw 86. The well therein is then ready to receive the downwardly projecting section 72 of the pivot arm 24. In this embodiment, the two rear or inner aligned feet are cut approximately $\frac{7}{8}$ inch up from the bottom edge thereof, leaving a slightly downwardly projecting section 104, as seen in FIG. 14. After cutting the 2 feet, two guide blocks 38 are secured, as by welding, to the inner face of the remaining feet 50. The reconstructed housing is used with the track 96 embodied in FIG. 14. The reamining feet 50 include the downwardly projecting sections 104 which guidably move along one side of the track 96 while the opposed guide blocks 38 extend below the top flange 98 of the track 96. Finally, in the fourth replacement method, the hook 36 is welded to the top wall 52 of one end section 42, as seen best in FIG. 5.

When using the housing embodiment of FIG. 8, the pin plug 34 is threaded into the threaded opening 80 until the top edge thereof is flush with the top surface of the intermediate section 30 and the plug 30 is fixed by a set screw. The housing, with the pin plug 34 therein becomes a replacement for the housing embodiment of FIG. 5, that is, the embodiment only with a well therein, and is used as shown in the embodiment of FIG. 16. With the pin plug 34 in place, the housing becomes a total replacement for one embodiment and may be reconstructed in the same way as the second and third embodiments mentioned above for the embodiment of FIG. 5.

Thus, it is seen from the foregoing that all of the foregoing objects have been accomplished. There has been provided a car door roller assembly replacement kit of simple and economical construction which may be readily used in accordance with my method to reconstruct the housing 28, of FIG. 5, or the alternate embodiment, as seen in FIG. 8, to provide replacement of different types of roller assemblies, up to at least four different types of car door roller assemblies. My invention enables the operator in the field, as in a railroad yard, to maintain only an inventory of my kits and not an inventory of many different types of roller assemblies. With my kit, it is possible to use the housing per se, with or without the addition of the roller members therein, and with relatively simple changes, requiring only welding and/or severing of parts of a housing by an operator in the field.

While in the foregoing, there has been provided a detailed description of particular embodiments of the present invention, it is to be understood that all equivalent obvious to those having skill in the art are to be included within the scope of the invention as claimed.

I claim:

1. A method for selectively replacing any of a plurality of different types of railroad car door roller assemblies, used with different types of railroad car door tracks, said method comprising the steps of supplying a roller assembly replacement kit which includes a housing having a pair of spaced end sections, each of said end sections being constructed and arranged to rotatably support a roller member for movement on a cooperating one of said tracks, each of said end sections having a pair of opposed side walls with downwardly projecting feet, an intermediate section for rigidly interconnecting said end sections, an upright aperture in said intermediate section, said kit also including separate guide members, a hook member, and at least one separate threaded member, said method further comprising the steps of threading said upright aperture of said housing, and threadably securing one of said threaded members into said threaded aperture, said housing with said threaded member thereby being a replacement for one of said types of said roller assemblies for use in connection with one of said tracks.

2. The method of claim 1 including the step of welding one of said guide members to each of said feet, said guide members being positioned to face each other.

3. The method of claim 1, wherein said end sections each have a top wall, and said method includes the steps of severing one of said feet of each of said end sections to a preselected height, said severed feet being in an aligned position, welding one of said guide members to the inner face of each of said remaining feet.

4. The method of claim 3 including the fourth step of welding said hook member to said top wall.

5. A method for selectively replacing any of a plurality of different types of railroad car door roller assemblies, used with different types of railroad car door tracks, said method comprising the steps of supplying a roller assembly replacement kit which includes a housing having a pair of spaced end sections, each of said end sections being constructed and arranged to rotatably support a roller member for movement on a cooperating one of said tracks, each of said end sections having a pair of opposed side walls with downwardly projecting feet, an intermediate section for rigidly interconnecting said end sections, and an upright aperture in said intermediate section, said kit also including separate guide members, said method further comprising the steps of severing one of said feet of each of said end sections to a preselected height, said remaining feet being in aligned position, and welding one of said guide members to the inner face of each of the remaining aligned feet, said housing thereby being a replacement for one of said types of roller assemblies for use in connection with one of said tracks.

* * * * *